United States Patent [19]

Johansson

[11] 4,298,173

[45] Nov. 3, 1981

[54] APPARATUS FOR UNWINDING OF A MATERIAL WEB

[76] Inventor: Kjell A. I. Johansson, Styrmansgatan 19, 311 00 Falkenberg, Sweden

[21] Appl. No.: 177,693

[22] Filed: Aug. 12, 1980

[30] Foreign Application Priority Data

Aug. 16, 1979 [SE] Sweden ..... 7906848

[51] Int. Cl.[3] ..... B65H 19/08; B65H 75/02

[52] U.S. Cl. ..... 242/58; 242/55

[58] Field of Search ..... 242/58.2, 55, 58, 58.6, 242/68.7, 78.7, 78.6

[56] References Cited

U.S. PATENT DOCUMENTS

| | | | |
|---|---|---|---|
| 3,582,010 | 6/1971 | Whiteman | 242/58 |
| 3,977,617 | 8/1976 | Salmon | 242/58 |
| 3,989,201 | 11/1976 | Cottrell | 242/55 |

*Primary Examiner*—Edward J. McCarthy

*Attorney, Agent, or Firm*—Beveridge, De Grandi, Kline & Lunsford

[57] ABSTRACT

The present invention relates to an apparatus for unwinding a material web (19), for example a paper web, which is wound up on a core (18), for example a paper core.

It is desirable to be able to reuse cores and remnant paper webs thereon separately. However, it is associated with relatively high costs to separate the paper web from the paper core.

The separation of the paper web from the paper core or stripping of the paper core is effected, according to the present invention, under purely machine-controlled methods by means of an apparatus with a device (1) which is arranged to support the core (18) with the web (19) and to rotate the core (18) with the web (19) while retaining the core (18) with the web (19) in a position during unwinding of the web (19); and with first means (29) which are disposed to discontinue the rotational drive when the core (18) is empty, whereupon the core (18) rolls away from the apparatus (1) because of its own rotation.

5 Claims, 1 Drawing Figure

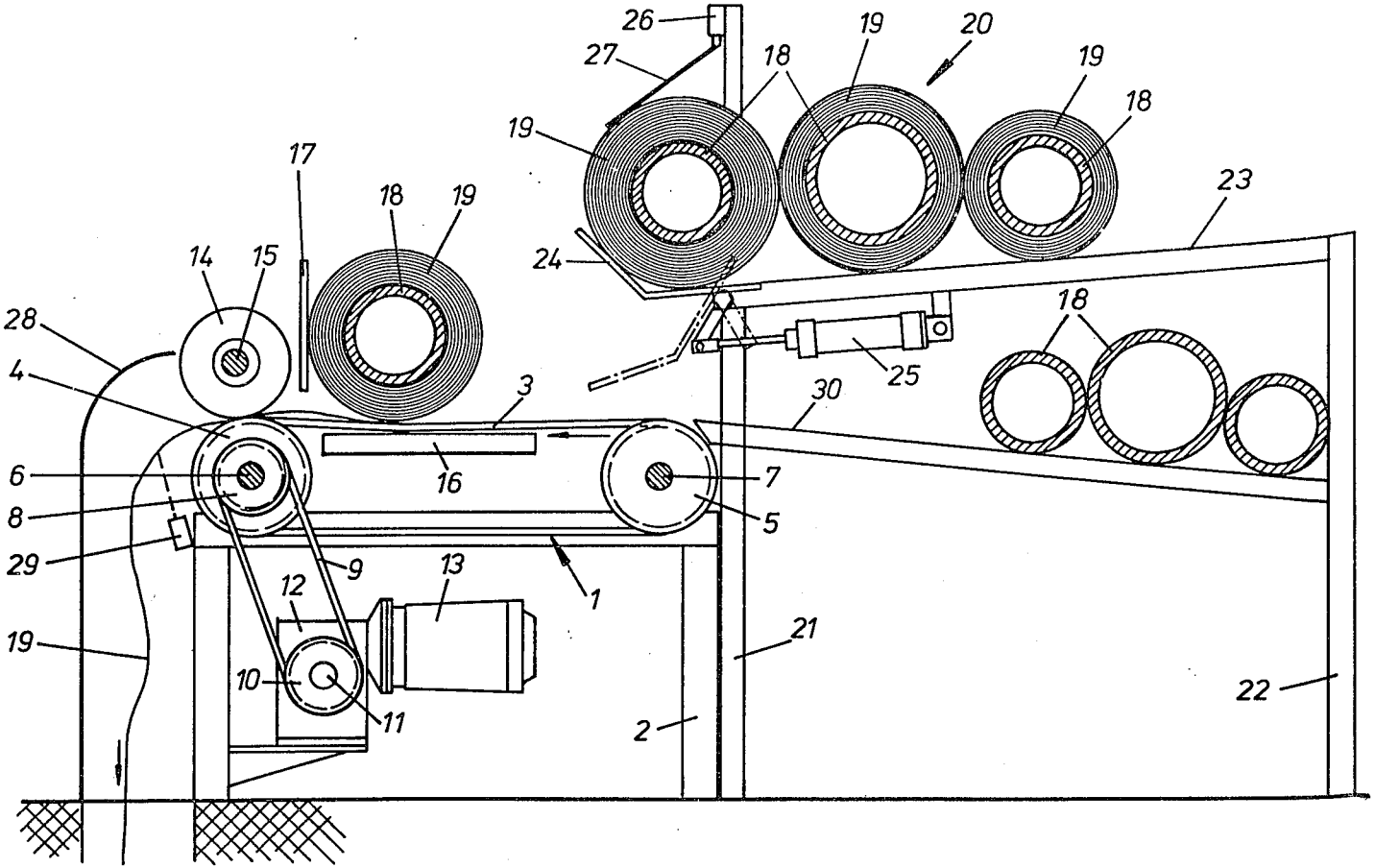
1
2
3
4
5
6
7
8
9
10
11
12
13
14
15
16
17
18
19
20
21
22
23
24
25
26
27
28
29
30

APPARATUS FOR UNWINDING OF A MATERIAL WEB

TECHNICAL FIELD

The present invention relates to an apparatus for unwinding of a material web, for example a paper web, which is wound up on a core, for example a paper core.

THE STATE OF THE ART AND TECHNICAL PROBLEM

In the manufacture of paper, the finished paper web is often wound up on paper cores which, normally, are in the form of cores having substantially the same width as the paper web, and are stored and handled in the form of such paper cores until the time of their subsequent use. In many contexts, it is desirable to avoid rupture within the machines which are fed with the paper webs, and, consequently, use is made of so-called snap splicing. One inconvenience with snap splicing is that a relatively great amount of paper must be retained on the paper core for purposes of achieving a reliable splice because of the great speeds with which the paper web is advanced through the machines. It is also desirable to be able to reuse the paper cores and also the remnant paper web. However, the separation of the remnant paper web from the paper core is associated with relatively high industrial costs. Both the paper web and the paper core are of great value in themselves, but, hitherto, the costs of separation of the two parts from each other have proved to be far too high. To be more precise, the scrap price for the paper core with the remnant paper web is from 5 to 10 times lower than if the paper core and the paper web could be separated from each other. In such an event, the paper core could be reused directly, whereas the paper web could be advanced or transferred to some other type of dissolving agent, possibly mechanical or chemical, prior to recycling into the papermaking process.

SOLUTION

The above-discussed problems are solved according to the present invention in that an apparatus has been provided for supporting a paper core with a material web, and for rotating the paper core with the material web while retaining the paper core and the material web in a position during unwinding of the material web; and that first means are provided to discontinue the rotational power when the paper core is empty, whereupon the core rolls away from its above-mentioned position as a result of its own rotation.

ADVANTAGES

The present invention makes for a mechanical emptying of paper cores or sleeves. This emptying takes place extremely rapidly without the need of manual assistance. Those cores which are to be emptied are, quite simply, placed in a magazine and are automatically emptied, such that the paper web may be directly led off to a receptacle device, whereas the cores are collected in a store of any given optional design.

DESCRIPTION OF THE DRAWINGS

The nature of the present invention and its aspects will be readily understood from the attached drawing which is a side elevation view of one embodiment of an apparatus according to the present invention, and discussion relating thereto.

DESCRIPTION OF THE PREFERRED EMBODIMENT

The apparatus shown on the drawing, according to the present invention, is provided with a conveyor path 1, which is mounted on a frame 2 and may consist of a conveyor belt, or a serie of one or more intermediately laterally spaced belts, for example V belts or the like. In the present apparatus, a number of V belts 3 is preferred, these extending over forward pulleys 4 and rear pulleys 5. The pulleys 4 and 5 are diposed in spaced apart relationship on a forward shaft 6 and a rear shaft 7, respectively. The pulleys 4 and 5 are fixedly disposed on the shafts 6 and 7 and, moreover, a further pulley 8 is disposed on the forward shaft 6, this pulley supporting a drive belt 9 which runs over a further pulley 10 on an output shaft 11 from a worm gear 12 which, in its turn, is driven by means of an electric motor 13. A pressure roller 14 is diposed above each one of the pulleys 4 and the shaft 6, the number of pressure rollers 14 being equal to the number of pulleys 4 and belts 3. The rollers 14 are disposed on a shaft 15 and together with the belts 3 form a nip. The pressure rollers 14 may, if desired, be replaced by means of a single roller. Beneath and between the belts 3, there are disposed one or more suction boxes 16. Ahead of the nip formed between the rollers 14 and belts 3, a stop device 17 is provided which prevents a core 18, for example a paper core, with a material web 19, for example a paper web, rolled up thereon, from rolling further on the belts 3, whereby the core 18 with the paper web 19 is caused to rotate against the stop device 17 when the belts 3 move in the direction indicated by means of the arrow, this direction being that which the upper belts 3 follow from the rearmost pulleys 5 to the forward pulleys 4.

Above the rear section of the conveyor apparatus 1, there is disposed a magazine 20 for cores 18 with a paper web 19. The magazine 20 is, quite simply, a frame with legs 21 and 22 and a platform 23 on which the cores repose while awaiting being fed down on the belts 3 and separation of the paper web 19. At the forward end of the magazine 20, there is a flap 24 which is pivotal from the position shown by solid lines to the position shown by dot-dash lines, by means of a piston and cylinder assembly 25. Above the paper roll located at the flap 24, there is a limit position determining member 26 with an operating arm 27 which is actuated by the roll at the flap 24.

After the nip formed between the rollers 14 and the belts 3, through which nip the paper web runs while being unwound from the core 18, there is disposed a funnel 28 through which the paper web 19 is led to some type of further processing. This further processing may consist of compression, dissolution or the like. The dissolution may take place mechanically or chemically, whereafter residual products may be reintroduced into the papermaking process. After the nip, there is further disposed a so-called photocell device 29. This device 29 serves purely and simply to sense if any paper web 19 is left after the nip. The device 29 may, therefore, consist of any given acceptable device within the art which is responsive to a paper web and, on the occurrence of a paper web after the nip, emits some type of signal.

Beneath the magazine 20, there is further provided a store platform 30 for cores 18 or paper cores, from which the paper web has been separated.

The mode of operation of the apparatus according to the present invention will be described hereinbelow in greater detail, the apparatus being preferably provided with a regulator device which operates within the scheme of the mode of operation as described below. When the limit position arm 27 is in the position shown on the drawing, the flap 24 will, by means of the piston and cylinder assembly 25, be switched to the position shown by means of the dot-dash lines, if the belts 3 are stationary and, thereby, if the electric motor 13 is not in operation. The flap 24 immediately reassumes the position shown by solid lines whereby but a single roll is fed down onto the belts 3, as shown on the drawing. The motor 13 energized if the belts 3 begin to move in the direction indicated by means of the arrow, and the core is moved up to the stop device 17 at which it is caused to rotate such that the paper web 19 is fed into the nip between the rollers 14 and the belts 3, and past the photocell 29. As long as the paper web 19 passes the photocell 29, the motor 13 is kept energized and, thereby, the belts 3. As soon as the photocell 29 is not broken by a material web 19, the motor 13 is arrested, and thereby the belts 3, whereby the core 18 will be caused to roll off the belts 3 in a direction towards the storage platform 30, this being dependent upon the fact that the belts 3 will be arrested relatively rapidly and that the core 18 continues to rotate and thereby roll off the belts 3 to the store 30.

When the web 19 consists of a relatively thin material stock, no suction box 16 is required. This is only required on the occasion of thicker material and will then be actuated simultaneously with the belts 3. Its function need be but brief in duration, since its purpose is merely to ensure the introduction of the material web into the nip between the rollers 14 and the belts 3.

As long as there are cores or rolls in the magazine 20, the above-described procedure will be repeated.

I claim:

1. An apparatus for unwinding a material web, for example a paper web, which is wound up onto a core, for example a paper core, characterised in that a device is disposed to support the core with the material web and to rotate the core with the material web during retention of the core with the material web in a position during unwinding of the material web; and that first means are provided to discontinue the rotation when the core is empty, whereupon the core rolls away from said apparatus because of its own rotation.

2. The apparatus as recited in claim 1, characterised in that said device is in the form of a short conveyor belt, preferably in the form of a number of belts on which the core with the material web is conveyed to second means for preventing continued conveyance of the core and thereby forming said position; continued movement of the conveyor belt entailing rotation of the core during unwinding of the material web from the core; and that said first means are disposed to arrest the conveyor belt when the core is empty, whereupon same solls away from the conveyor belt in the opposite direction with respect to the conveyance direction.

3. The apparatus as recited in claims 1 or 2, characterised in that there is disposed, in the conveyance direction, after said position, at least one roller nip in which the material web is fed from the core.

4. The apparatus as recited in claims 1 or 2, characterised in that a magazine with cores having a material web is disposed above the conveyor belt for downward release of a core with a material web one-at-a-time onto to the conveyor belt.

5. The apparatus as recited in claims 1 or 2, characterised in that means are provided beneath the conveyor belt at said position for drawing the material web towards the conveyor belt.

* * * * *